United States Patent [19]

Aoki et al.

[11] Patent Number: 4,954,684

[45] Date of Patent: Sep. 4, 1990

[54] VERTICAL TYPE HEAT-TREATING APPARATUS AND HEAT-TREATING METHOD

[75] Inventors: Kazutsugu Aoki, Sagamihara; Noboru Fuse, Yokohama; Yoshio Sakamoto, Machida, all of Japan

[73] Assignee: Tel Sagami Limited, Kanagawa, Japan

[21] Appl. No.: 313,904

[22] Filed: Feb. 23, 1989

[30] Foreign Application Priority Data

Feb. 26, 1988 [JP] Japan ..... 63-45059
Feb. 26, 1988 [JP] Japan ..... 63-45061

[51] Int. Cl.[5] ..... F27B 5/14; F27D 11/02; H05B 3/62

[52] U.S. Cl. ..... 219/390; 219/411; 118/50.1

[58] Field of Search ..... 219/390, 405, 411; 118/725, 729, 50.1

[56] References Cited

U.S. PATENT DOCUMENTS 3,828,722 8/1974 Reuter et al. .
4,695,706 9/1987 Mizushina ..... 219/390
4,760,244 7/1988 Hokynar ..... 219/411

FOREIGN PATENT DOCUMENTS 46-7910 2/1971 Japan .
58-60552 4/1983 Japan .
61-183525 11/1986 Japan .

*Primary Examiner*—Teresa J. Walberg
*Attorney, Agent, or Firm*—Oblon, Spivak, McClelland, Maier & Neustadt

[57] ABSTRACT

A vertical type heat-treating apparatus has a process tube, disposed upright along the lengthwise direction, for receiving a target object to heat-treat it under a predetermined condition, and a heater, provided around the process tube, for heating the target object in the process tube. After heat treatment is executed with the heater disposed around the process tube, the heater is moved upward by an elevator away from the process tube for cooling down the inside of the process tube.

8 Claims, 6 Drawing Sheets

VERTICAL TYPE HEAT-TREATING APPARATUS AND HEAT-TREATING METHOD

BACKGROUND OF THE INVENTION

1. Field of the Invention

The present invention relates to a vertical type heat-treating apparatus and a heat-treating method for effecting heat treatment such as an oxidation or diffusion process on an object to be treated or a target object, such as a semiconductor wafer.

2. Description of the Related Art

In effecting a heat treatment such as an oxidation or diffusion process on a semiconductor wafer, a plurality of wafers are mounted on a quartz glass boat and this boat is carried inside a process tube of a heat-treating apparatus. Conventionally, horizontal type heat-treating apparatuses which have a process tube disposed horizontal along its length, have been used as such a heat-treating apparatus for wafers (refer to U.S. Pat. No. 3,828,722).

However, recent enlargement of wafers and an increased number of wafers to be mounted on a boat (e.g., 150 wafers) inevitably enlarges the heat-treating apparatuses, so that the following shortcomings arise for the horizontal type. Since the process tube is disposed horizontal along its length in the horizontal type heat-treating apparatus, a large mounting area should be provided according to the length. Therefore, enlargement of the apparatus inevitably increases the mounting area, which makes the apparatus inappropriate for installment in a clean room whose cost per unit area is high. Further, since the tare of a boat having wafers mounted thereon is directly applied to the process tube in the horizontal type heat-treating apparatus, the process tube is unlikely to be able to endure the total weight of the boat increased by an increase in the number of wafers. In addition, since the boat carrying-in and carrying-out directions differ from the direction in which the tare of the boat is applied, the boat is more likely to directly contact the process tube due to bending of a carrying-in fork, resulting in easy generation of particles.

To overcome the above problems, vertical type heat-treating apparatuses have recently been used for heat treatment of semiconductor wafers (refer to Japanese Utility Model Disclosure No. 61-183525 and Japanese Patent Disclosure No. 58-60552). In the vertical type heat-treating apparatuses, the process tube is disposed vertically, a boat having semiconductor wafers mounted thereon is carried in the process tube through the opening at its lower end, the interior of the process tube is heated by a heater disposed around the tube, and a reaction gas is introduced in the tube to subject the wafers to heat treatment.

Since the vertical type heat-treating apparatuses can have a smaller mounting area than the horizontal type and can permit a boat to be disposed in the process tube without contacting it, the aforementioned shortcomings of the horizontal type heat-treating apparatuses can be overcome. In addition, the vertical type heat-treating apparatuses have higher uniformity of a temperature applied to the wafers and higher uniformity of a gas distribution, as compared with the horizontal type, thus ensuring higher yield. Therefore, the vertical type heat-treating apparatuses can cope with an increase in the diameter of the process tube resulting from enlargement of wafers and can be easily automated.

To apply such a vertical type heat-treating apparatus to, for example, an apparatus for providing a silicon epitaxial growth, the interior of the process tube is maintained at about 1000° C. in an epitaxial growth process. If the wafer is taken out from the process tube from the high-temperature environment of about 1000° C. immediately after the completion of this process, an undesired oxidization film may be formed on the wafer surface or the grown epitaxial film may be adversely affected. It is therefore necessary to cool the wafer to about 800° C. before it is removed; this may be done by reducing the output of the heater around the process tube or turning off the heater power to cool the wafer to about 800° C. within the process tube.

Since, as mentioned earlier, the vertical type heat-treating apparatuses are used to cope with large numbers of wafers, however, the heater generally has a large heat capacity so that the heater itself is not quickly cooled even by turning off the heater power. Accordingly, it takes a long time to reduce the temperature of wafers in the process tube to 800° C. from about 1000° C., several times longer than the time required for the epitaxial grown. Even if the epitaxial grown process itself is completed in, for example, about 10 minutes, therefore, the time required for the entire heat treatment for one cycle becomes longer than one hour, so that the throughput cannot be improved.

SUMMARY OF THE INVENTION

Accordingly, it is an object of this invention to provide a vertical type heat-treating apparatus and a heat-treating method for use in a vertical type heat treating apparatus, which have a shorter time for the entire one-cycle heat treatment and ensure a higher throughput.

According to one aspect of this invention, there is provided a vertical type heat-treating apparatus which comprises:

a process tube, disposed vertically in a lengthwise direction thereof, for receiving a target object for treatment and treating the target object under a predetermined condition;

heating means, disposed around the process tube at a time a heat treatment is effected, for heating the target object within the process tube; and position changing means for changing a relative position of the process tube and the heating means by moving the process tube or the heating means.

According to another aspect of this invention, there is provided a vertical type heat-treating apparatus which comprises:

a process tube, disposed vertically in a lengthwise direction thereof, for receiving a target object for treatment and treating the target object under a predetermined condition, the process tube having a heat-treating zone and a cooling zone; and heating means, disposed around the process tube, for heating the target object within the process tube, the heating means having a first heater for heating the heat-treating zone to a heat-treating temperature and a second heater for heating the cooling zone to a cooling temperature lower than the heat-treating temperature respectively provided in association with the heat-treating zone and the cooling zone in such a way that outputs of the first heater and second heater are set to predetermined values to thereby set a temperature in the heat-treating zone to the heat-treating temperature and a temperature in the cooling zone to the cooling temperature.

According to a further aspect of this invention, there is provided a heat-treating method for use in a vertical type heat-treating apparatus having a process tube, disposed vertically in a lengthwise direction thereof, for receiving a target object for treatment and treating the target object under a predetermined condition, and heating means, disposed around the process tube, for heating a target object for treatment within the process tube, which method comprises the steps of:

causing the heating means to form a heat-treating zone and a cooling zone in the process tube, the heat-treating zone being set to a heat-treating temperature and the cooling zone being set to a cooling temperature lower than the heat-treating temperature of the heat-treating zone;

setting the target object to the heat-treating zone in the process tube and subjecting the target object to heat treatment;

setting the target object to the cooling zone and cooling the target object to the cooling temperature; and removing the target object from the process tube.

DETAILED DESCRIPTION OF THE PREFERRED EMBODIMENT

Preferred embodiments of this invention will now be described referring to the accompanying drawings. The following description will be given with reference to the case where this invention is applied to an apparatus for providing silicon epitaxial growth.

Figure 1:
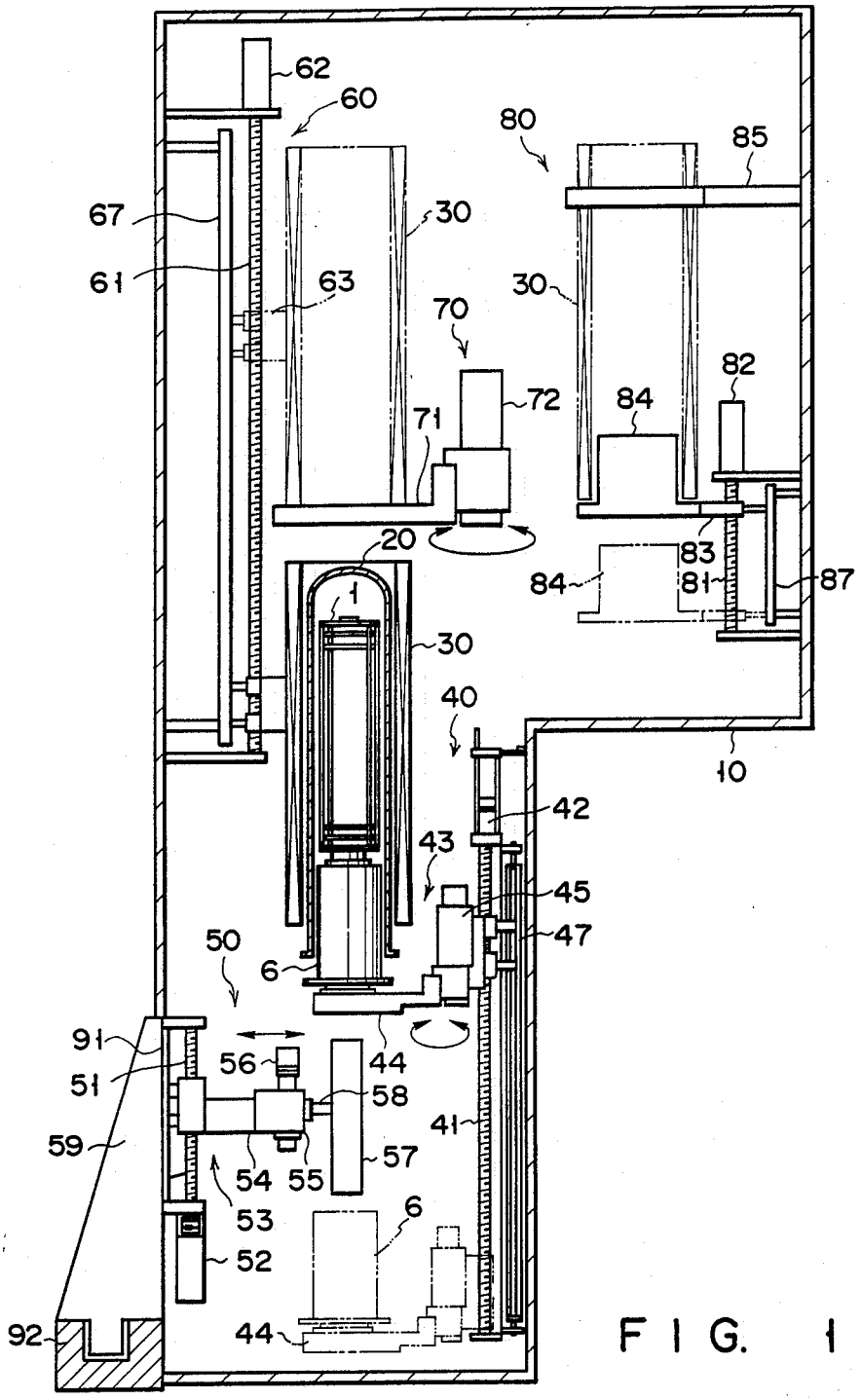
FIG. 1 is a cross-sectional view of a vertical type heat-treating apparatus according to one embodiment of this invention.

FIG. 1 is a cross section of a heat-treating apparatus according to one embodiment of this invention. This apparatus comprises a housing 10, a process tube 20, a heater 30, a first elevator 40, a handler device 50, a second elevator 60, a heater-rotating device 70 and a heater-holding mechanism 80. The process tube 20 is disposed vertically along its length, and a boat 1 (to be described later in detail) having semiconductor wafers W is inserted in the tube at the time of heat treatment. The heater 30, which is disposed vertically movable, is set to be around the process tube 20 at the time of heat treatment and heats up the wafers W in the tube. The first elevator 40 serves to carry the boat 1 in, and from, the process tube 20. The handler device 50 serves to carry the boat 1 outside the housing 10 from directly under the process tube 20 or carry the boat 1 inside the housing 10 to directly under the tube 20. The second elevator 60 moves the heater 30 between a heat-treating position and a separating position located above the former position. The heater-rotating device 70 moves the heater 30 rotating between the separating position and a retreat position located on one side thereof. The heater-holding mechanism 80 holds the heater 30 at the retreat position.

Figure 2:
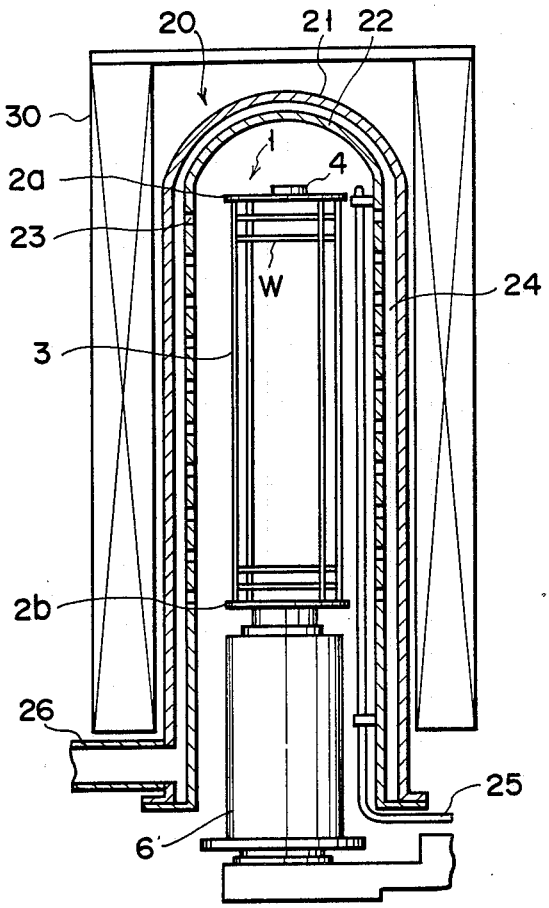
FIG. 2 is a diagram illustrating a boat being carried inside a process tube in the heat-treating apparatus shown in FIG. 1.
Figure 3:
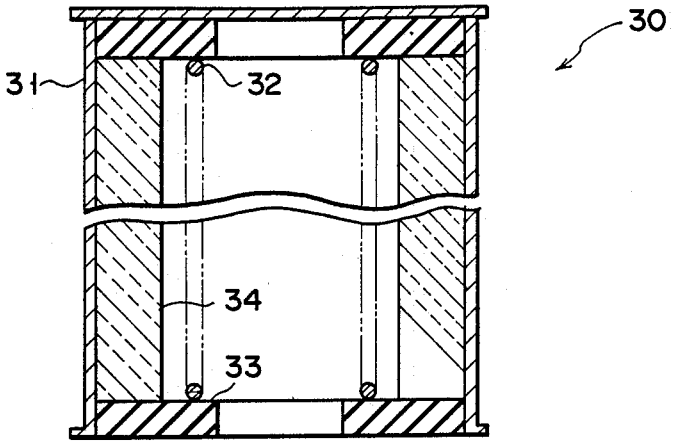
FIG. 3 is a longitudinal cross-sectional view illustrating a heater of the heat-treating apparatus of FIG. 1.

A plurality of wafers W to be heat-treated are mounted on the boat 1, which is in turn placed in the process tube 20 in the state as shown in FIG. 2. The boat 1 is made of quartz glass, and has an upper plate **2*a* and a lower plate 2*b* provided at the respective end portions and four support rods 3 for connecting these end plates 2*a* and 2*b*. The support rods 3 each have a plurality of grooves (not shown) formed at equal intervals for alignment and support of the respective wafers. A pin 4 for clamping the boat 1 is provided on the top surface of the upper plate 2*a*, and a flange 5 is provided outside, and apart from, the lower plate 2*b*. The boat 1 is placed upright on a heat insulating cylinder 6 and is inserted in the process tube 20 from the opening at the bottom thereof. The heat insulating cylinder 6 serves to place the boat 1 in a soaking area in the process tube 20 at the time of heat treatment as well as to insulate heat in the tube and prevent gas from leaking from the tube. This heat insulating cylinder 6 may be constituted to be rotatable so as to rotate boat 1. In this case, the temperature uniformity and gas density uniformity in the process tube 20** are further improved.

As shown in FIG. 2, the process tube 20 has an outer cylinder 21 and an inner cylinder 22, which has a plurality of through holes 23 formed therein. A gas passage 24 is formed between the outer and inner cylinders 21 and 22. A gas introducing duct 25 is inserted upward from the bottom end of the process tube 20 along the inner wall of the inner cylinder 22. A process gas can be introduced inside the inner cylinder 22 from this gas introducing duct 25.

A gas exhaust duct 26 is provided outward at the lower end portion of the outer cylinder 21, on the opposite side of the gas introducing duct 25. A waste gas resulting from heat treatment is discharged, by a vacuum pump (not shown) coupled to the gas exhaust duct 26, from the inside of the inner cylinder 22 through the holes 23, passage 24 and gas discharging duct 26.

Although not illustrated, means for sealing the process tube 20 and heat insulating cylinder 6 is provided under the process tube 20.

The first elevator 40 has a ball screw 41 vertically extending, a motor 42 for rotating the ball screw, and a moving section 43 which is engaged with the ball screw 41 and vertically moves while being guided by a guide 47 with the rotation of the ball screw. The moving section 43 has a support member 44 provided at its lower end portion in a rotatable manner within a horizontal plane, the heat insulating cylinder 6 being mounted on this support member 44. The moving section 43 further has a motor 45 which rotates the support member 44 within the horizontal plane. The moving section 43 and heat insulating cylinder 6 move between the inserting position as indicated by the solid line in FIG. 1 and the retreat position as indicated by the two-dotted chain line. The support member 44 and heat insulating cylinder 6, when placed at the retreat position, are rotated by the motor 45. This prevents the heat insulating cylinder 6 from interfering the operation of the handler device 50.

The handler device 50, provide on the opposite side of the first elevator 40 with the process tube 20 in between, has a ball screw 51 vertically extending, a motor 52 for rotating the ball screw 51, a moving member 53 engaged with the ball screw 51, a handler 57 provided at the distal end of the moving member 53, and a transport section 59 for transporting the boat 1. The moving member 53 is vertically movable while being guided by a guide 91 by the rotation of the ball screw 51. The handler 57 clamps the boat 1 when the boat is carried outside or inside the process tube 20, and has a mount section on which the boat is placed and a holding arm for holding the boat (both not shown); this handler 57 is rotatable around a shaft 58 and is horizontally movable. The moving member 53 has a horizontal moving section 54 movable in the horizontal direction, a horizontal guide member 55 for guiding this section 54, and a motor 56. This motor 56 causes the handler 57 together with the horizontal moving section 54 to move horizontally and rotates the handler 57 together with the shaft 58. Although not illustrated, the horizontal movement may be executed by a rack and pinion mechanism while the rotating movement may be done by a helical gear mechanism.

The transport section 59 supports the ball screw 51 and guide 91, and is provided movable along a rail 92 so that it can transport the boat 1 to other processing apparatus from this heat-treating apparatus or vice versa.

The heater 30 has a cover 31 made of, for example, stainless steel, a heater coil 32 of an electric resistor type, formed in a spiral form, for example, a heat shielding member 34 provided between the cover 31 and the heater coil 32, and a support member 33 for supporting the coil 32. The heater 30 is supplied with power from a power source (not shown) in accordance with a target temperature.

The second elevator 60, provided above the handler device 50, has a ball screw 61 vertically extending, a motor 62 for rotating the ball screw 61, and a heater support member 63 which is engaged with the ball screw 61. This heater support member 63 vertically moves while being guided by a guide 67 with the rotation of the ball screw 61 and removably supports the heater 30. With the above arrangement, therefore, rotation of the motor 62 permits the heater 30 to move between a process position outside the process tube 20 and the separating position, located above the former position and as indicated by the two-dotted chain line in FIG. 1.

The heater-swing device 70, provided directly above the process tube 20, has a mount section 71 on which the heater 30 is mounted and a motor 72 for rotating the mount section 71 within a horizontal plane. The mount section 71 is placed at such a position as to avoid interference with the movement of the heater 30 when the heater 30 is moved upward by the second elevator 60, and is set directly below the heater 30 to support it when the heater reaches the separating position. When the heater 30 in this state is detached from the support member 63 of the second elevator 60 and the mount section 71 is rotated by the motor 72, the heater 30 is moved to the retreat position.

The heater-holding mechanism 80, provide on the opposite side of the second elevator 60, has a ball screw 81 vertically extending, motor 82 for rotating the ball screw 81, a moving section 83, which is engaged with the ball screw 81 and vertically moves while being guided by a guide 87 with the rotation of the ball screw 81, a support/heat-insulating member 84 secured to the moving section 83 for supporting the heater 30 as well as providing heat insulation thereof, an arm 85, which is provided above the member 84 and clamps the heater 30 when the heater is moved to the retreat position. The mount section 71 of the heater swing device 70 is moved under the heater 30 being clamped by the arm 85, and the support/heat-insulating member 84 is moved upward from the retreat position, indicated by the two-dotted chain line, to support the heater 30 as well as keep the temperature thereof.

A description will now be given of a one-cycle sequence of a silicon epitaxial growth process in thus constituted vertical type heat-treating apparatus.

STEP 1 (Boat Inserting Step)

First, wafers which have been processed by another process apparatus are mounted on the boat 1. This boat 1 is supported in a substantially horizontal state, for example, by the handler 57 of the handler device 50, and the transport section 59 under this condition is moved along the rail 92 to carry the boat 1 to the heat-treating apparatus of this embodiment from the mentioned process apparatus. The boat 1 is moved directly below the process tube 20 and is rotated until it stands upright. Then, the heat insulating cylinder 6 is placed on the support member 4, they are rotated to come directly under the process tube 20 so as to place the boat 1 on the heat insulating cylinder 6, and the handler 57 is retreated sideways after the boat 1 is released from the support of the handler 57. Then, the support member 44 and heat insulating cylinder 6 are moved upward by the first elevator 40 to insert the boat 1 in the process tube 20. As the boat 1 is placed upright along the lengthwise direction, the wafers W are aligned horizontal.

In this case, since the insertion direction of the boat 1 coincides with the direction in which the tare of the boat 1 is applied, the boat does not contact the process tube 20 due to bending of the fork unlike in the case of the aforementioned horizontal type heat-treating apparatus. This prevents generation of impurities and significantly improves the yield of the semiconductor wafers. The heater 30 is placed at the process position in this STEP 1.

The time required for the boat 1 to be inserted in the process tube 20 after its arrival at the heat-treating apparatus in the STEP 1 is about 5 minutes.

STEP 2 (Gas Purging Step)

An inert gas, such as N2 gas, is introduced in the process tube 20 from the gas introducing duct 25 to purge the inside of the tube 20. In conducting the Purging process, gas inside the process tube 20 is discharged through the holes 23, passage 24 and gas exhaust duct 26 while introducing the $N_2$ gas inside the tube. By carrying out this step for about 5 minutes, the inside of the process tube 20 can be completely purged by the $N_2$ gas.

STEP 3 (Heating Step)

Power is supplied to the heater strand 32 of the heater 30 to heat up the interior of the process tube 20 until the temperature in the tube 20 reaches the optimum temperature for the silicon epitaxial growth, for example, about 1000° C.

STEP 4 (Annealing/Etching Step)

If necessary, an etching gas is introduced from the gas introducing duct 25 to execute vapor etching while carrying out an annealing at this temperature. At this time, the waste gas after the etching in the process tube 20 is discharged outside the heat-treating apparatus through the holes 23, passage 24 and gas exhaust duct 26. The time required for this process is about 10 minutes.

STEP 5 (Silicon Epitaxial Growth Step)

Then, a process gas is introduced from the gas introducing duct 25 and the wafers are subjected to a silicon epitaxial growth process. Upon completion of this process, the waste gas is discharged outside the apparatus through the gas discharging duct 26 by driving the vacuum pump. With the epitaxial film being a 5-μm thick, this process takes about 10 minutes.

STEP 6 (Cooling Step)

After the silicon epitaxial growth step is completed, the heater 30 is moved, by the second elevator 60, from the process position to the separating position above the former position so that the heater 30 is separated from the process tube 20. More specifically, the ball screw 61 is rotated by the motor 62 and the support member 63 is moved upward along the guide 67, thereby moving the heater 30 upward.

As the heater 30 is separated completely from the process tube 20, the outer wall of the process tube 20 can directly contact the outside air. That is, since the heat from the heater 30 does not affect the cooling process in the process tube 20, the speed for cooling the interior of the process tube 20 can be increased significantly.

In the cooling step, the interior of the process tube 20 is cooled down to about 800° C. from about 1000° C. The cooling time required is about 20 minutes, about a half the time required by the conventional apparatus (about 40 minutes).

To aim solely at increasing the cooling speed of the process tube 20, it is sufficient to move the heater 30 to the separating position. According to this embodiment, however, the heater 30 is further moved to the retreat position during the cooling process to keep the temperature of the heater 30 in order to shorten the heating time for the next cycle. In this case, the heater 30 is moved to the retreat position by first detaching the heater from the support member 63 and then rotating the mount section 71 by the motor 72 of the heater-rotating device 70. The heater 30 is held at the retreat position by the heater-holding mechanism 80. More specifically, the mount section 71 of the second elevator 70 is moved under the heater 30 being clamped by the clamp arm 85, and the support/heat-insulating member 84 is moved to the retreat position indicated by the two-dotted chain line to support the heater 30.

As the heater 30 is supported by the member 84, the opening at the lower end of the heater 30 is blocked and the temperature of the heater is maintained. Conventionally, after the process tube is heated up to 1000° C., the heater is turned off to carry out the cooling process until the temperature inside the process tube is cooled down to 800° C. With the present method described above, the temperature of the heater can be maintained at a temperature slightly lower than 1000° C. This can significantly shorten the time for heating up the process tube in the next cycle. According to this embodiment, the time required to heat up the process tube to 1000° C. again in the next cycle takes about 10 minutes, a half the time required by the conventional method (about 20 minutes).

STEP 7 (Boat Removing Step)

When the temperature inside the process tube 20 is reduced to about 800° C., an inert gas, such as $N_2$ gas, is introduced in the process tube 20 to purge the inside the tube and the boat 1 with the wafers W mounted thereon is carried out from the process tube 20. This removing process can be done through the reverse sequence of the insertion step (STEP 1) by the first elevator 40 and handler device 50.

The use of the first elevator 40 and handler device 50 as shown in FIG. 1 provides the following advantage. When a long boat with many wafers mounted thereon is used and the heat insulating cylinder 6 is long, the height of the housing 10 necessary for the insertion and removal of the boat can be set lower than that required in the case where these two units are not used. This is particularly advantageous when the height of the apparatus at the installing place is limited.

Figure 4A:
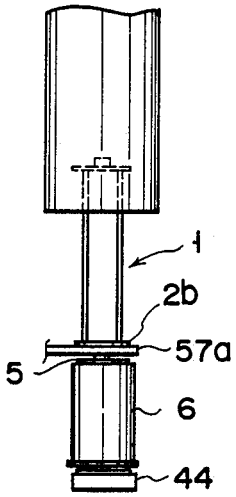
FIGS. 4A through 4C are exemplary diagrams illustrating the operation for removing the boat from the process tube in the heat-treating apparatus of FIG. 1.
Figure 4B:
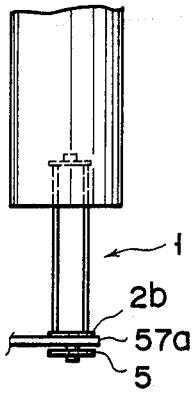
Figure 4C:
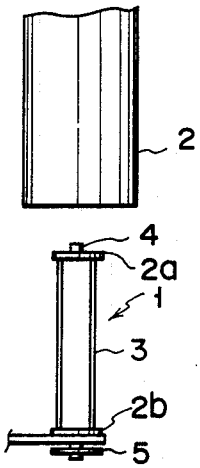

The reason why the housing 10 can have a shorter height will now be described in detail with reference to the boat removal step in conjunction with FIGS. 4A–4C. As shown in FIG. 4A, the boat 1, its top portion still remaining inside the process tube 20 at the time the boat 1 is removed, is placed on a mount section **57*a* of the handler 57. Then, the support member 44 and heat insulating cylinder 6 are rotated by the motor 45 to retreat from directly under the boat 1, as shown in FIG. 4B. In this state, the handler 57 is lowered by driving the motor 52 so as to completely expose the boat 1 from the process tube 20. Accordingly, the height of the housing 10 can be made shorter by the length of the heat insulating cylinder 6**.

As described above, the cooling time for the process tube in one-cycle heat treatment process can be significantly reduced as compared with the time required by the conventional method. This can shorten the overall heat treatment time and significantly improves the throughput. According to the conventional method, the larger the heat-treating apparatus, the longer the cooling time for the process tube. By separating the heater from the process tube in the above-described manner, however, the cooling time can be significantly shortened even with a large heat-treating apparatus is in use. In addition, since the heating time in the cycles following the first cycle can be shorted by maintaining the temperature of the heater held at the retreat position, the throughput can be further improved.

Figure 5:
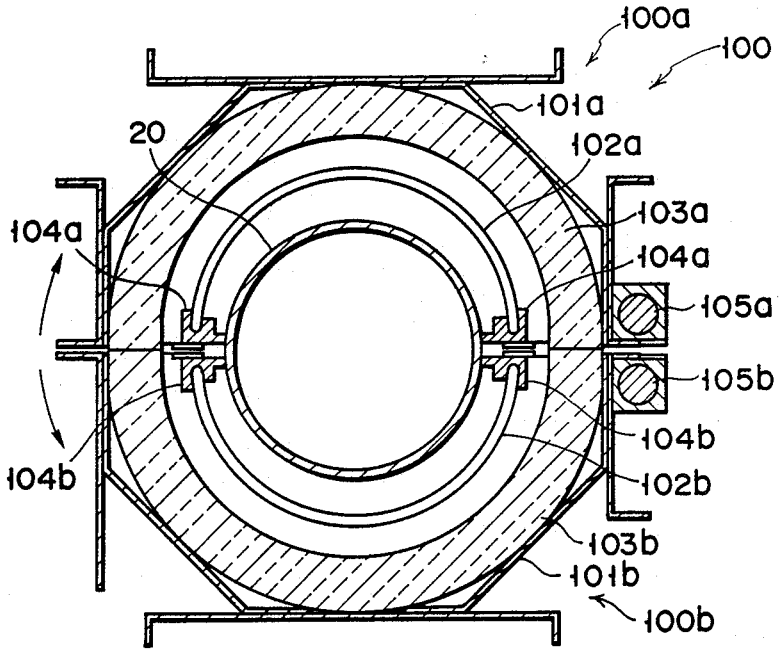
FIG. 5 is a lateral cross-sectional view illustrating a modification of the heater.

Although the heater is moved upward to be separated from the process tube according to the above embodiment, a separable, i.e., clam shell heater as shown in FIG. 5 may be used when the heat-treating apparatus is installed where the ceiling is low. This heater 100 is provided around the process tube 20 and has bisected heaters **100*a* and 100*b* each having a semicircular cross section. Cases 101*a* and 101*b*, made of stainless steel, are provided at the peripheral portions of the respective bisected heaters. The bisected heaters 100*a* and 100*b* have heater strands 102*a* and 102*b* that directly surround the outer wall of the process tube 20, heat-insulating members 103*a* and 103*b* being respectively disposed between the cases 101*a* and 101*b* and the strands 102*a* and 102*b*. Heater strand support members 104*a*** and 104*b*, two each, are attached to the facing end portions of the heater strands. The bisected heaters 100*a* and 100*b* are supported rotatable by support rods 105*a* and 105*b*, respectively, and can be rotated around these rods to be opened and closed with respect to each other.

With thus constituted heater 100 in use, the bisected heaters 100*a* and 100*b* are joined together in the silicon epitaxial growth process, they are rotated around the support rods 105*a* and 105*b* away from each other after the process, and the heater 100 is separated away from the process tube 20. Accordingly, the influence of the heat from the heater can be reduced as per the above-described embodiment at the time the inside of the process tube 20 is cooled down. This can considerably shorten the cooling time for the process tube 20 and can improve the throughput accordingly.

This design of the heater eliminates the need to retreat the heater upward, and is therefore effective when the heat-treating apparatus is installed in a clean room with a limited height to the ceiling.

In using such a heater, the heater may be retreated horizontally from the process tube while kept open, thus further shortening the cooling time. At this time, the time for heating up the process tube in the heat treatment in the next cycle can also be shortened by maintaining the temperature of the heater separated from the process tube, in the same manner as done in the above embodiment.

Means for changing the relative position of the process tube and the heater as heating means to separate them from each other is not limited to the aforementioned two mechanisms, but other various mechanisms may be used as such separating means. For instance, this means may be designed to move the heater downward for its retreat movement or move the process tube together with the boat away from the heater.

Another embodiment will now be described in which the heater disposed around the process tube is bisected to upper and lower portions and the process tube has two zones associated with the bisected heaters.

Figure 6:
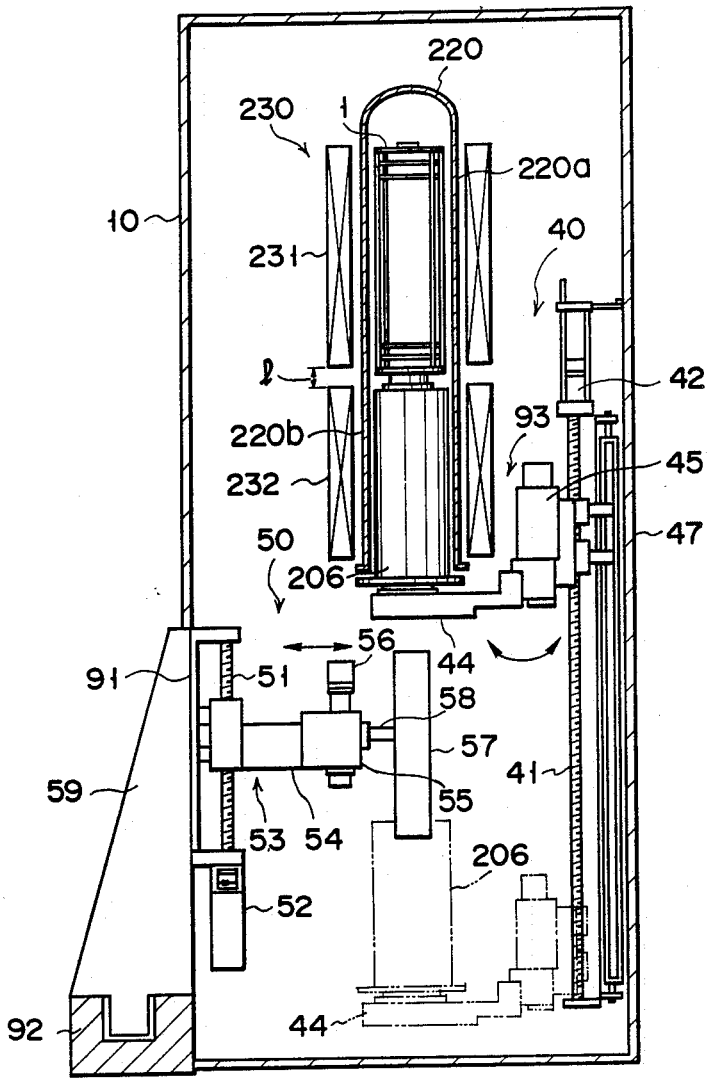
FIG. 6 is a cross-sectional view of a vertical type heat-treating apparatus according to another embodiment of this invention.
Figure 7:
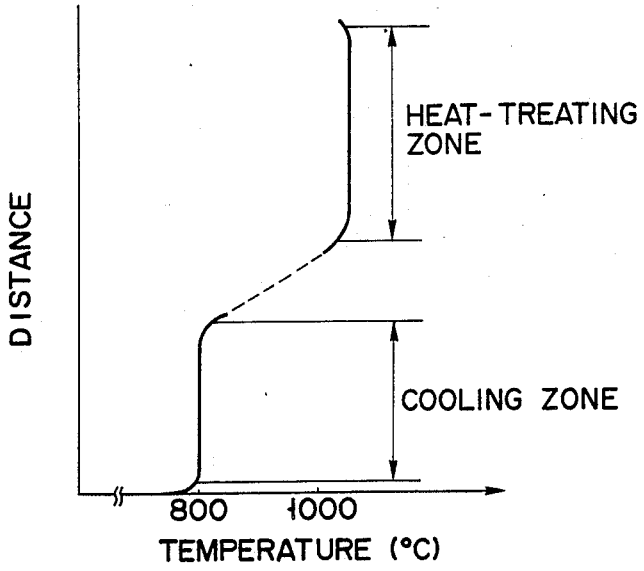
FIG. 7 is a graph illustrating a temperature distribution in the process tube at the time a heat treatment is conducted by the heat-treating apparatus shown in FIG. 6.

FIG. 6 is a cross-sectional view of a vertical type heat-treating apparatus according to the second embodiment. The same reference numerals as used in FIG. 1 are also used in this diagram to specify the identical or corresponding components, thus omitting their description. A process tube 220, like the process tube 20, is made of quartz glass and has the same structure as the tube 20. The process tube 220 is, however, longer than the tube 20, and has a heat-treating zone 220*a* at its upper portion and a cooling zone at its lower portion. The temperature in the heat-treating zone 220*a* is set to a heat-treating temperature and the temperature in the cooling zone to a cooling temperature. A heater 230 is of an electric resistor type as per the heater 30, and has an upper heater 231 and a lower heater 232 which are constituted in the same manner as the heater 30. The upper heater 231 is provided around the heat-treating zone 220*a* of the process tube 220, and the lower heater 232 around the cooling zone 220*b*. In an actual process, the upper heater 231 keeps the temperature of the heat-treating zone 220*a* at the heat-treating temperature, for example, 1050° C. and the lower heater 232 keeps the temperature of the cooling zone 220*b* at the cooling temperature, for example, 800° C. Although the temperature in each zone is kept substantially uniform, a predetermined temperature gradient is provided between these two zones. The width of each zone can be properly set by varying the distance l between the upper heater 231 and lower heater 232. In particular, when both zones are demanded of a high temperature uniformity and the temperature difference between these zones is large, it is preferable to keep a good temperature uniformity by adjusting the distance between the upper heater 231 and lower heater 232.

Since a heat insulating cylinder 206 is located above the process tube 220, it is taller than the heat insulating cylinder 6.

A description will now be given of a one-cycle sequence of a silicon epitaxial growth process in thus constituted vertical type heat-treating apparatus.

STEP 1 (Boat Inserting Step)

The insertion of the boat 1 in the process tube 220 is performed in the same manner as done in the first embodiment. In this case, although the boat 1 is placed finally in the heat-treating zone 220*a* in the process tube 220, the wafers may be pre-heated by stopping the boat 1 in the cooling zone 220*b* before reaching the heat-treating zone 220*a* and permitting the boat to slowly pass the zone 220*b*.

The subsequent STEPs 2 (gas Purging step), 3 (heating step), 4 (annealing/etching step) and 5 (silicon epitaxial growth step) are executed in the same manner as done in the first embodiment.

STEP 6 (Cooling Step)

Figure 8:
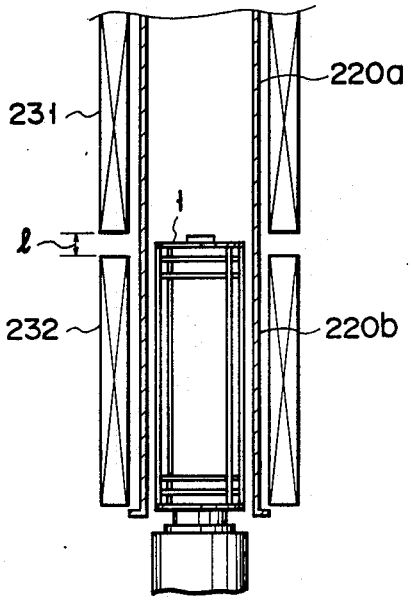
FIG. 8 is a diagram illustrating a cooling step for the apparatus shown in FIG. 6.

Before the boat is carried outside the process tube 220, the boat is lowered to come to the cooling zone 220*b*, kept at 800° C., as shown in FIG. 8. Unlike the prior art, this embodiment does not also require that the inside of the process tube be cooled by controlling the temperature of the heater, thus significantly shortening the cooling time for the process tube as per the first embodiment.

STEP 7 (Boat Removing Step)

The boat 1 is removed from the process tube in the same manner as done in the first embodiment. In the second embodiment, since two zones are provided in the process tube 220, the tube and the heat insulating cylinder 206 should be made longer, thus requiring a greater moving stroke at the time the boat 1 is removed from the tube. The use of the handler device 50 and elevator 40 for insertion and removable of the boat 1 can effectively reduce the moving stroke by the length of the long heat insulating cylinder 206.

Although both of the heat-treating zone and cooling zone are set to be soaking zones in this embodiment, the cooling zone should not necessarily be a soaking zone. It is, however, preferable that the cooling zone be a soaking zone if this zone is used as a pre-heating zone coming before heat treatment. Although the boat 1 is moved between the heat-treating zone and cooling zone, some modification may be made to move the heater instead. With the use of a heater having a 3-zone or 5-zone system, the above two zones can be formed by controlling the temperatures of the individual zones.

Although a target object is inserted in or removed from the process tube from the lower portion thereof in the above two embodiments, the insertion and removal may be done from the upper portion of the process tube.

Furthermore, the invention is in no way restricted to an apparatus for providing silicon epitaxial growth, but it can be applied to various kinds of vertical type heat-treating apparatuses which perform heat treatment of a target object in a process tube.

What is claimed is:

1. A vertical type heat-treating apparatus comprising;

a process tube, disposed vertically in a lengthwise direction thereof, for receiving a support mounting target objects for treatment and treating said target objects under a predetermined condition;

heating means, disposed around said process tube at a time a heat treatment is effected, for heating said target object within said process tube; and position changing means for changing a relative position of said process tube and said heating means after the heat treatment is performed, by vertically moving said process tube or said heating means such that said process tube is set to a position out of said heating means, wherein said position changing means has a moving device for moving said heating means, wherein said moving device has a vertical movement mechanism for vertically moving said heating means between a heat-treating position and a separating position located above said heat-treating position, and wherein said moving device further has a horizontal movement mechanism for moving said heating means between said separating position and a retreat position located sideways of said separating position.

2. The apparatus according to claim 1, further comprising heat-insulating means for maintaining a temperature of said heating means when said heating means is at said retreat position.

3. The apparatus according to claim 1, further comprising inserting/removing means for inserting said target object in said process tube and removing said target object therefrom.

4. A vertical type heat-treating apparatus comprising:

a process tube, disposed vertically in a lengthwise direction thereof, for receiving a support mounting target objects for treatment and treating said target objects under a predetermined condition, said process tube having a heat-treating zone and a cooling zone;

heating means, disposed around said process tube, for heating said target object within said process tube, said heating means having a first heater for heating said heat-treating zone to a heat-treating temperature and a second heater for heating said cooling zone to a cooling temperature lower than said heat-treating temperature respectively provided in association with said heat-treating zone and said cooling zone in such a way that outputs of said first heater and second heater are set to predetermined values to thereby set a temperature in said heat-treating zone to said heat-treating temperature and a temperature in said cooling zone to said cooling temperature; and moving means for moving said support from said heat treating zone to said cooling zone after the heat treatment is performed.

5. The apparatus according to claim 4, wherein said heat-treating heater is located below said cooling heater.

6. The apparatus according to claim 4, further comprising inserting/removing means for inserting said target object in said process tube and removing said target object therefrom.

7. A heat-treating method for use in a vertical type heat-treating apparatus having a process tube, disposed vertically in a lengthwise direction thereof, for receiving a support mounting target objects for treatment and treating said target objects under a predetermined condition, and heating means, disposed around said process tube, for heating a target object for treatment within said process tube, which method comprises the steps of:

causing said heating means to form a heat-treating zone and a cooling zone to said process tube, said heat-treating zone being set to a heat-treating temperature and said cooling zone being set to a cooling temperature lower than said heat-treating temperature of said heat-treating zone;

setting said target object to said heat-treating zone in said process tube and subjecting said target object to heat treatment;

setting said target object to said cooling zone and cooling said target object to said cooling temperature after heat treating; and removing said target object from said process tube, wherein said heating means vertically moves to a separating position located above said process tube, including the step of horizontally moving said heating means from said separating position to a retreat position located sideways of said separating position.

8. The method of claim 7 wherein said cooling zone is located below said heating zone.

* * * * *